US007055349B2

(12) United States Patent
Morita et al.

(10) Patent No.: US 7,055,349 B2
(45) Date of Patent: Jun. 6, 2006

(54) YARN FEEDING DEVICE FOR FLAT KNITTING MACHINE

(75) Inventors: Toshiaki Morita, Wakayama (JP); Hirokazu Nishitani, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/522,172

(22) PCT Filed: Jul. 22, 2003

(86) PCT No.: PCT/JP03/09225

§ 371 (c)(1),
(2), (4) Date: Jan. 24, 2005

(87) PCT Pub. No.: WO2004/009894

PCT Pub. Date: Jan. 29, 2004

(65) Prior Publication Data

US 2006/0090520 A1 May 4, 2006

(30) Foreign Application Priority Data

Jul. 24, 2002 (JP) ..... 2002-215589

(51) Int. Cl.
*D04B 15/48* (2006.01)

(52) U.S. Cl. ..... 66/146

(58) Field of Classification Search ..... 66/146, 66/125 R, 126 R, 210–213; 242/416, 418.1
See application file for complete search history.

(56) References Cited

U.S. PATENT DOCUMENTS

| | | | | |
|---|---|---|---|---|
| 3,858,416 | A * | 1/1975 | White et al. | 66/132 R |
| 4,720,985 | A * | 1/1988 | Goller et al. | 66/146 |
| 4,752,044 | A | 6/1988 | Memminger et al. | |
| 4,942,908 | A * | 7/1990 | Imamura | 139/99 |
| 4,966,333 | A * | 10/1990 | Bosch | 242/412.3 |
| 5,375,435 | A * | 12/1994 | Gille et al. | 66/211 |
| 5,421,534 | A * | 6/1995 | Arnold et al. | 242/419.5 |
| 6,010,052 | A | 1/2000 | Leins et al. | |
| 6,550,285 | B1 | 4/2003 | Nishitani | |

FOREIGN PATENT DOCUMENTS

| | | |
|---|---|---|
| JP | 55-4869 B2 | 2/1980 |
| JP | 55-4869 (B2) | 2/1980 |
| JP | 1-49816 B2 | 10/1989 |
| JP | 1-49816 (B2) | 10/1989 |

(Continued)

*Primary Examiner*—Danny Worrell
(74) *Attorney, Agent, or Firm*—Harness, Dickey & Pierce

(57) ABSTRACT

An object of the invention is to be provide a yarn feeding apparatus of a flat knitting machine capable of accurately predicting a required amount of a knitting yarn and knitting a fabric while supplying knitting yarn necessary for knitting. The knitting yarn is fed out based on an idea shown in a solid line in consideration of a yarn speed corresponding to the requirement for knitting yarn produced according to the movement of a yarn feeding member as shown by chain lines in FIG. 6(*b*). A knitting yarn is stored on a buffer rod at a start of knitting because the speed of a motor such as a servo motor for feeding a knitting yarn lags behind the yarn speed. A knitting yarn that runs short at the time of deceleration at an end of knitting is also fed out in advance.

17 Claims, 10 Drawing Sheets

FOREIGN PATENT DOCUMENTS

| | | |
|---|---|---|
| JP | 5-77165 (U) | 10/1993 |
| JP | 77165/1993 | 10/1993 |
| JP | 2541574 (B2) | 10/1996 |
| JP | 11-500500 (A) | 1/1999 |
| JP | 2951068 B2 | 9/1999 |
| JP | 2951068 (B2) | 9/1999 |

* cited by examiner

FIG. 8

| ROD POSITION AT START OF KNITTING (ABSOLUTE ROD POSITION) | STITCH DENSITY DURING KNITTING | ROD POSITION AT END OF KNITTING (ABSOLUTE ROD POSITION) | (i) PREVIOUS CORRECTION OF ROD ORIGIN POSITION | (ii) CORRECTION OF ROD CHANGE | (iii) CURRENT CORRECTION OF ROD ORIGIN POSITION | CORRECTION TABLE VALUE FOR EACH COURSE | | |
|---|---|---|---|---|---|---|---|---|
| | | | | | | CORRECTION TABLE 1 (i)+(ii) | CORRECTION TABLE 2 (iii) | |
| ( 0) | --42--> | (-2) | -- | -2 | -2 | -2 | -2 | |
| (-2) | --38--> | ( 0) | -2 | +2 | 0 | -2 | 0 | |
| ( 0) | --40--> | ( 0) | 0 | 0 | 0 | -2 | 0 | CONVERGENCE FLAGS ON |
| ( 0) | --40--> | ( 0) | 0 | 0 | 0 | -2 | 0 | |

| | | | | | | | | |
|---|---|---|---|---|---|---|---|---|
| KNIT PORTION(◎) | 1 | 1 | 0 | 1 | 1 | 2 | 0 | 1 |
| TUCK PORTION(△, ▽) | 0 | 1 | 0 | 0 | 0 | 0 | 1 | 0 |
| MISS (·) | 0 | 0 | 1 | 0 | 0 | 0 | 0 | 0 |
| CROSSING PORTION (=) (FRONT TO REAR) | 0 | 1.0 | 0 | 0.5 | 0.5 | 1.0 | 0 | 0 |
| CROSSING PORTION (=) (REAR TO FRONT) | 0 | 0.5 | 0 | 0.5 | 0.5 | 1.0 | 0.5 | 0 |

| | | | | | | | | |
|---|---|---|---|---|---|---|---|---|
| KNIT PORTION(◎) | 1 | 0 | 0 | 1 | 1 | 1 | 0 | 1 |
| TUCK PORTION(△, ▽) | 0 | 1 | 0 | 0 | 0 | 0 | 1 | 0 |
| MISS (·) | 0 | 0 | 1 | 0 | 0 | 0 | 0 | 0 |
| CROSSING PORTION (=) (FRONT TO REAR) | 0.5 | 0.5 | 0 | 0.5 | 0.5 | 0 | 0 | 0 |
| CROSSING PORTION (=) (REAR TO FRONT) | 0 | 0.5 | 0 | 0.5 | 0.5 | 0.5 | 0 | 0 |

YARN FEEDING DEVICE FOR FLAT KNITTING MACHINE

TECHNICAL FIELD

The present invention relates to a yarn feeding apparatus of a flat knitting machine with which a length of a supplied knitting yarn for knitting a knitting fabric can be controlled according to knitting data.

BACKGROUND ART

Conventionally, a flat knitting machine 1 such as schematically shown in FIGS. 11 and 12 is provided with a yarn feeding apparatus 6, for example, on a side cover 5 that is on one end side of a needle bed in a longitudinal direction so that a knitting yarn 4 is supplied from a yarn feeding port of a yarn feeding member 3 to knitting needles while knitting a knitting fabric 2. The yarn feeding apparatus 6 supplies the knitting yarn 4 in accordance with a carriage (not shown) moving along the needle-bed so that a knitting operation of the knitting fabric is performed for one course. The carriage is provided with a cam mechanism for letting knitting needles perform a knitting operation, and is further provided with a mechanism for moving the yarn feeding member 3 from which the knitting yarn 4 is supplied to the knitting needles that are currently performing a knitting operation. Generally, a plurality of yarn feeding members 3 and yarn feeding apparatuses 6 are provided, so that a plurality kinds of knitting yarns 4 can be supplied. However, in this specification, the structure is simplified and only one for each is shown.

A buffer rod 7 is included in the yarn feeding apparatus 6, and serves to temporarily store the knitting yarn 4 and to apply a tension to the knitting yarn 4. The buffer rod 7 can displace the front end side 9 thereof by swinging around a base end side 8 that is supported by the side cover 5. The front end side 9 of the buffer rod 7 pulls the knitting yarn 4 by a force of a spring, and is stable when the force of the spring is balanced with the tension of the knitting yarn 4. A length measuring roller 10 is provided on a path on which the knitting yarn 4 is supplied, and measures the length of the knitting yarn 4 that is supplied from the yarn feeding apparatus 6 to the yarn feeding member 3. When a measurement is performed with the measuring roller 10, it is possible to control the stitch density representing an amount that the carriage pulls the knitting needles for knitting the knitting fabric 2, so that the consumption amount of the knitting yarn 4 matches an amount estimated in advance based on knitting data.

FIG. 11 shows the positional relationship of the yarn feeding member 3 in the flat knitting machine 1 when the carriage starts to move from one end side to the other end side of the needle bed, that is, in a direction away from the yarn feeding apparatus 6. FIG. 12 shows the positional relationship of the yarn feeding member 3 when the carriage has moved to the other end side of the needle bed and the yarn feeding member 3 has moved to the end of the knitting fabric 2 on the side away from the yarn feeding apparatus 6. In the flat knitting machine 1, the length of the knitting yarn 4 that is necessary between the yarn feeding apparatus 6 and the yarn feeding member 3 changes in accordance with the positional relationship of the yarn feeding member 3 with respect to the knitting fabric 2.

In the conventional yarn feeding apparatus 6 that stores the knitting yarn 4 and applies a tension to the same, depending on the inclination degree of the buffer rod 7, the buffer rod 7 stores the knitting yarn 4 to the maximum extent when the yarn feeding member 3 is at the end of the knitting fabric 2 on the side of the yarn feeding apparatus 6 as indicated by broken line in FIG. 11. When a knitting operation of the knitting fabric 2 for the next course starts, the carriage moves the yarn feeding member 3 in the direction away from the yarn feeding apparatus 6. The knitting yarn 4 is pulled, and thus the inclination of the buffer rod 7 becomes small as indicated by solid line. As shown in FIG. 12, when the yarn feeding member 3 is moved close to the end of the knitting fabric 2 on the side away from the yarn feeding apparatus 6, the required amount of the knitting yarn 4 decreases, and thus the inclination of the buffer rod 7 again becomes large as indicated by the broken line, so as to pull and store a larger amount of the knitting yarn 4. Since the inclination of the buffer rod 7 corresponds to the tension of the knitting yarn 4, a change in the tension of the knitting yarn 4 becomes large during a knitting operation when the knitting yarn 4 is applied with a tension and is stored by using the inclination of the buffer rod 7.

Japanese Examined Patent Publication JP-B2 2541574, for example, discloses a conventional technique in which a tension is applied to a knitting yarn and spare storage is performed to cope with a drastic change in the tension of the knitting yarn, by using a member corresponding to the buffer rod 7, such as shown in FIGS. 11 and 12, in order to suppress the change in the tension of the yarn while actively sending out the knitting yarn. Japanese Unexamined Patent Publication JP-A 11-500500 (1999) discloses a conventional technique in which the rotation of a spinning wheel for sending out a knitting yarn is controlled before a drastic change in a requirement of the yarn, without using a member corresponding to the buffer rod 7, such as shown in FIGS. 11 and 12, in order to suppress the change in the tension of the yarn.

As described above, in the conventional yarn feeding apparatus 6 such as shown in FIGS. 11 and 12, the required amount of the knitting yarn 4 significantly changes in accordance with a position to which the yarn feeding member 3 has moved while knitting the knitting fabric 2 by using the flat knitting machine 1, and thus the tension of the yarn is also changed in accordance with the requirement of the yarn. A drastic change in a tension of a yarn causes a change in the length of a knitting stitch loop in a knitting width direction of the knitting fabric 2, and thus the quality of the knitting fabric 2 is deteriorated.

The conventional technique disclosed in Japanese Examined Patent Publication JP-B2 2541574 also has a difficulty in coping with a drastic change in a required amount of a yarn that occurs, for example, at an end portion of a knitting fabric. The conventional technique described in Japanese Unexamined Patent Publication JP-A 11-500500 (1999) is expected to be capable of coping with a drastic change in a required amount of a knitting yarn. However, since this conventional technique needs to wind a knitting yarn around a spinning wheel, the spinning wheel becomes large. Flat knitting machines often knit a knitting fabric by using a plurality of yarns, and thus such flat knitting machines need to include a yarn feeding mechanism for each yarn. When flat knitting machines include a plurality of yarn feeding apparatuses each of which uses a large spinning wheel, the flat knitting machines become large.

In the conventional technique shown in FIGS. 11 and 12, even when it is attempted to measure the length of the already supplied knitting yarn 4 with the measuring roller 10 in order to supply the necessary knitting yarn 4 according to knitting data of the knitting fabric 2, the accurate amount of the knitting yarn for the entire width of the knitting fabric 2 cannot be identified. For example, in FIG. 11, which shows a starting point for collecting data, the length of the knitting yarn 4 can be measured accurately only at a position that is inward from the end of the knitting fabric 2 by more than a length L1 that is several centimeters. This is because when the buffer rod 7 is inclined from the state indicated by the solid line to the state indicated by the broken line, also the stored amount of the knitting yarn 4 that is increased when the buffer rod 7 is inclined is measured with the measuring roller 10, and thus the accurate consumption amount of the knitting yarn 4 that is supplied to the knitting fabric 2 becomes unidentified. Furthermore, the amount of the knitting yarn 4 that is supplied when the buffer rod 7 returns from the state indicted by the broken line to the state indicated by the solid line cannot be measured directly with the measuring roller 10. In FIG. 12, which shows an ending point for collecting data, the length of the knitting yarn 4 indicated by broken line cannot be identified. Without identifying the accurate length of the knitting yarn 4, even when the stitch density is controlled so that the consumption amount of the knitting yarn 4 matches an amount that is estimated in advance based on knitting data, a sufficient effect cannot be attained.

The conventional technique in Japanese Examined Patent Publication JP-B2 2541574 or Japanese Unexamined Patent Publication JP-A 11-500500 (1999) does not describe any configuration relating to an accurate estimation of a required amount of a knitting yarn.

DISCLOSURE OF INVENTION

An object of the invention is to provide a yarn feeding apparatus of a flat knitting machine with which a required amount of a knitting yarn can be estimated accurately, so that a knitting operation can be performed while supplying a knitting yarn that is necessary for the knitting operation.

The invention provides a yarn feeding apparatus of a flat knitting machine that supplies a knitting yarn to knitting needles performing a knitting operation based on knitting data while moving a yarn feeding member in a width direction of a knitting fabric, including:

a knitting yarn sending mechanism that is provided on a supplying path of a knitting yarn and that sends out the knitting yarn to the yarn feeding member;

a buffer rod that is provided on a path on which a knitting yarn is supplied from the knitting yarn sending mechanism to the yarn feeding member, that can be displaced by swinging around a base end side, that pulls partially the knitting yarn out of the path when a front end side thereof is displaced to one side by swinging, and that returns the knitting yarn to the path when the front end side is displaced to the other side by swinging;

a spring that applies a force to the buffer rod in such a manner that the front end thereof is displaced to the one side by swinging so that the knitting yarn of a predetermined length is pulled out of the path with a predetermined tension of the yarn;

a sensor that detects a swinging displacement state of the buffer rod using as a reference an origin that is a position of the front end side when the knitting yarn is pulled out of the path only for the predetermined length, and that derives a signal showing a detection result; and control means for performing a pattern analysis based on knitting data, for calculating a theoretical value of a knitting stitch loop length to be knitted for each knitting needle, for controlling the knitting yarn sending mechanism in a necessary yarn sending mode in which the knitting yarn is sent out in synchronization with a movement of the yarn feeding member, and for correcting an element affecting a predetermined knitting stitch loop length before and after knitting one course of a knitting fabric in such a manner that an error between a length of a knitting yarn supplied for one course actually measured by the sensor based on an angle change in the swinging displacement of the buffer rod and a theoretical value of the knitting stitch loop length for one course is absorbed.

Furthermore, the invention is characterized in that as the element affecting the knitting stitch loop length, at least one of a stitch density as a preset value of a knitting cam for knitting stitches and a tension of the knitting yarn is corrected.

Furthermore, the invention is characterized in that the control means performs control in the necessary yarn sending mode in such a manner that as the knitting stitch loop length calculated for each knitting needle, an average value of knitting stitch loop lengths of knitting needles belonging to a group including the knitting needle at a knitting stitch for knitting a same course of a knitting fabric is sent out from the knitting yarn sending mechanism.

Furthermore, the invention is characterized in that the control means aligns the buffer rod, during control in the necessary yarn sending mode, based on a detection result by the sensor, by using a part of a knitting yarn sent during a knitting operation, in such a manner that the position of the front end side of the buffer rod stays in a predetermined vicinity of the origin position, before and after knitting one course of a knitting fabric.

Furthermore, the invention is characterized in that when the sensor detects that a swinging displacement state of the buffer rod is beyond a predetermined limit during control in the necessary yarn sending mode, the control means stops the control in the necessary yarn sending mode, and controls the knitting yarn sending mechanism in a remedy mode in which the front end side of the buffer rod is returned to the origin position.

Furthermore, the invention is characterized in that the controlling means controls the knitting yarn sending mechanism in a switchable mode between the necessary yarn sending mode and a mode with a constant tension in which based on a signal from the sensor, the front end side of the buffer rod is controlled to be kept in a vicinity of the origin position so that a tension of the knitting yarn is kept constant.

Furthermore, the invention is characterized in that the control means performs adjustment prior to a knitting operation of a knitting fabric in the mode with a constant tension in such a manner that a stitch density as the preset value of the knitting cam for knitting stitches is adjusted so that a predetermined loop length can be knitted.

Furthermore, the invention is characterized in that the control means calculates a length of a knitting yarn to be sent out according to the knitting data, separately for a zone in which the knitting yarn is sent out before starting a knitting operation at one end of a knitting fabric, a zone from the start of the knitting operation at the end of the knitting fabric to a start of deceleration of sending out the knitting yarn from the knitting yarn sending mechanism, a zone from the start of deceleration of sending out the knitting yarn from the knitting yarn sending mechanism to a completion of knitting up to the other end of the knitting fabric, and a zone from the completion of the knitting operation of the knitting fabric to a stop the knitting yarn sending mechanism.

BRIEF DESCRIPTION OF DRAWINGS

Other and further objects, features, and advantages of the invention will be more explicit from the following detailed description taken with reference to the drawings wherein:

FIG. 8 is a diagram showing an example of correction table data in a moving rightward operation in the embodiment shown in FIG. 1;

BEST MODE FOR CARRYING OUT THE INVENTION

Figure 1:
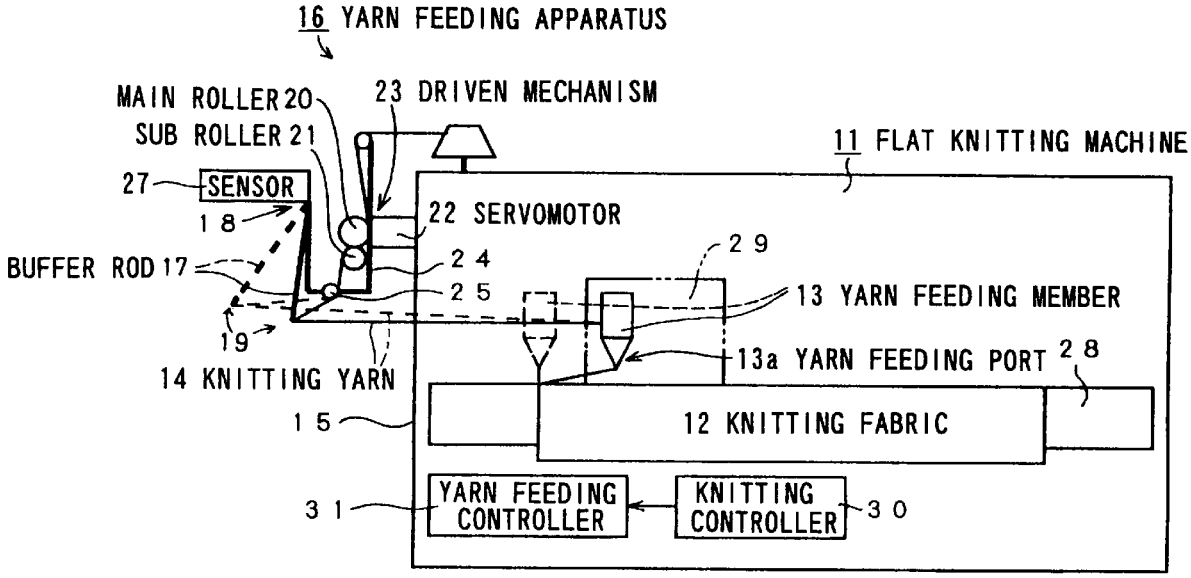
FIG. 1 shows a block diagram of a schematic structure of an embodiment of the invention.

Now referring to the drawings, preferred embodiments of the invention are described below.

FIG. 1 shows a schematic structure of a yarn feeding apparatus of a flat knitting machine as an embodiment of the invention. A flat knitting machine 11 supplies a knitting yarn 14 from a yarn feeding port 13*a* of a yarn feeding member 13 to knitting needles in order to knit a knitting fabric 12. A side cover 15 or the like of the flat knitting machine 11 is provided with a yarn feeding apparatus 16 that supplies the knitting yarn 14 to the yarn feeding port 13*a* with a change in a tension being suppressed and at an appropriate length to meet a requirement. The yarn feeding apparatus 16 is provided with a buffer rod 17. In the buffer rod 17, the portion up to a front end side 19 can be displaced by swinging about a base end side 18 as a supporting point, and a force of a spring is applied to the front end side 19 in a direction away from the surface of the side cover 15, so that the buffer rod 17 is inclined to be balanced with a tensile force generated by the tension of the knitting yarn 14. When the tension of the knitting yarn 14 becomes large, the buffer rod 17 is moved close to the surface of the side cover 15 by resisting the force of the spring, so that the knitting yarn 14 of a length corresponding to this swinging degree can be supplied to the side of the yarn feeding port 13*a*.

Figure 2:
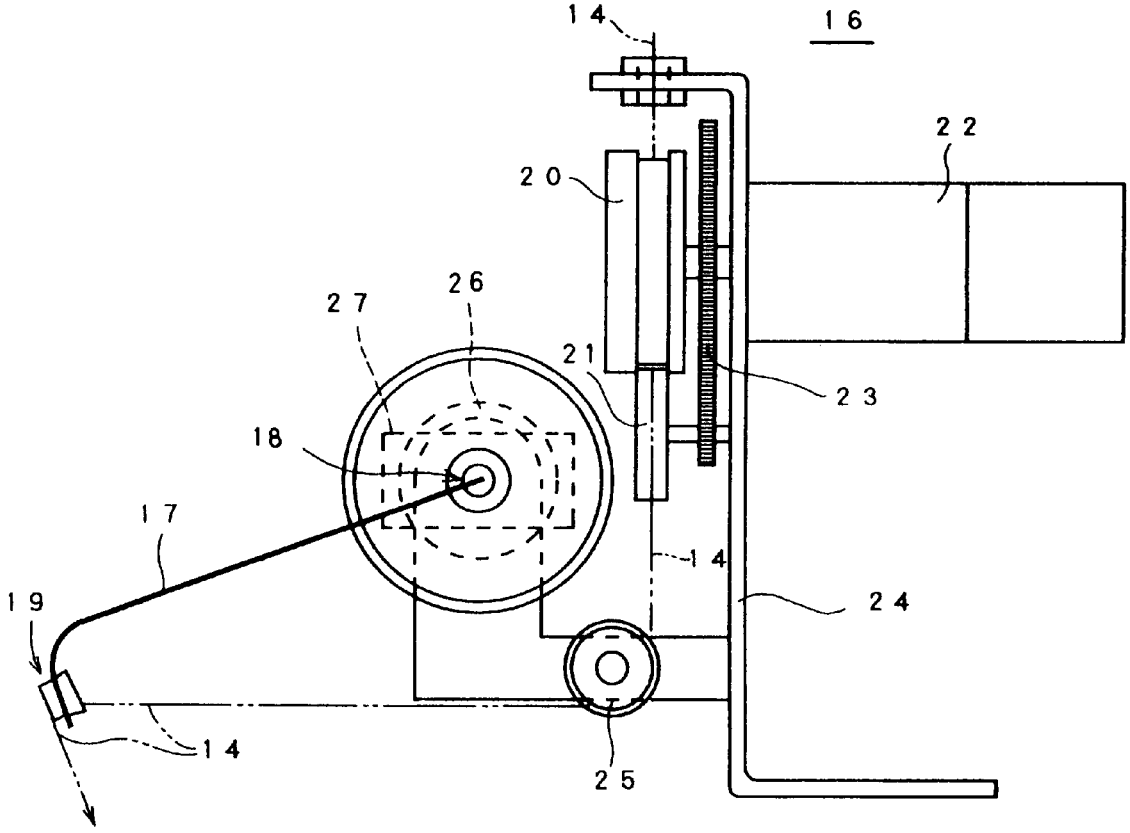
FIG. 2 shows a front view of the yarn feeding apparatus 16 in FIG. 1.
Figure 3:
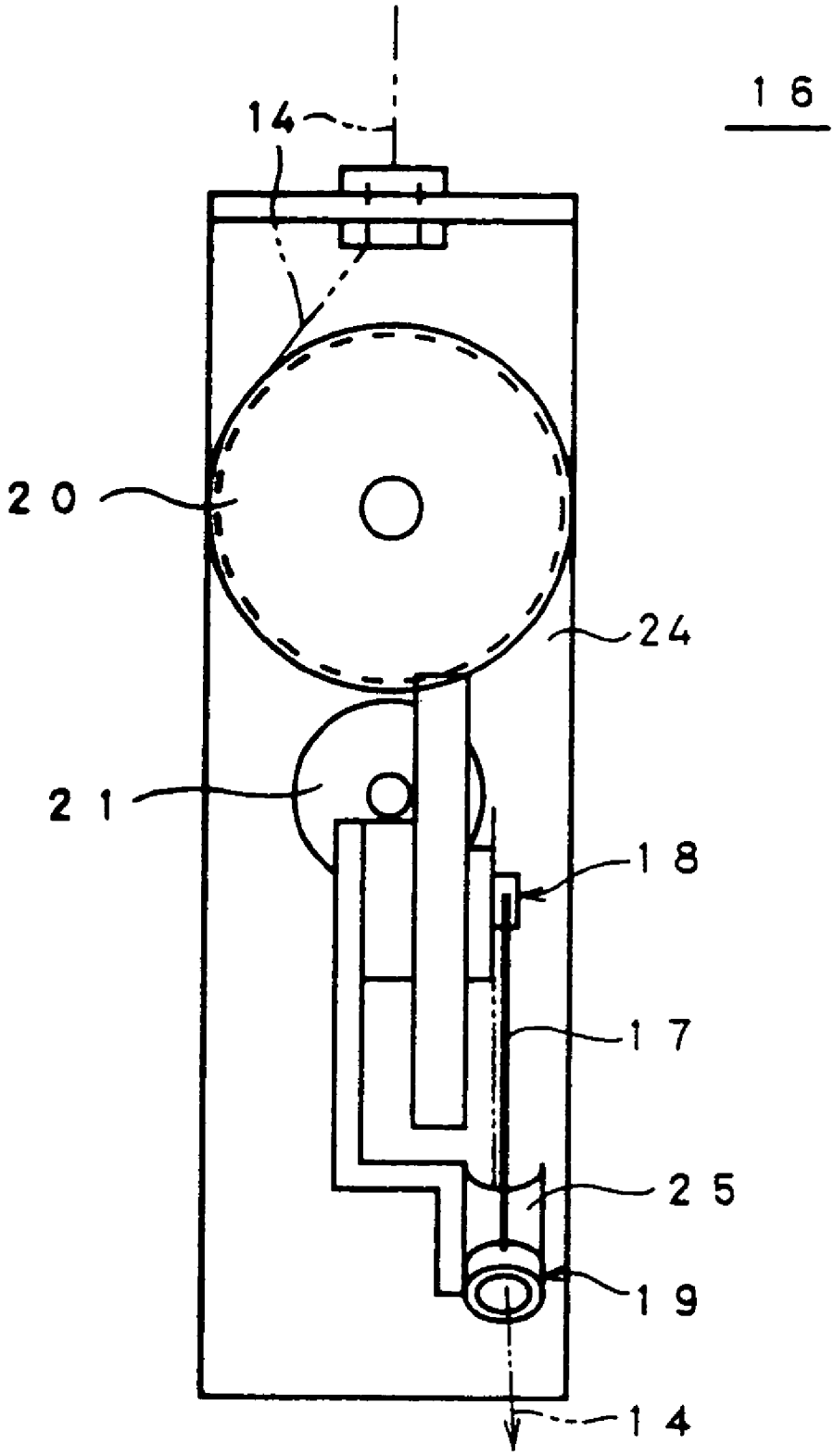
FIG. 3 shows a left side view of the yarn feeding apparatus 16 in FIG. 1.
Figure 4:
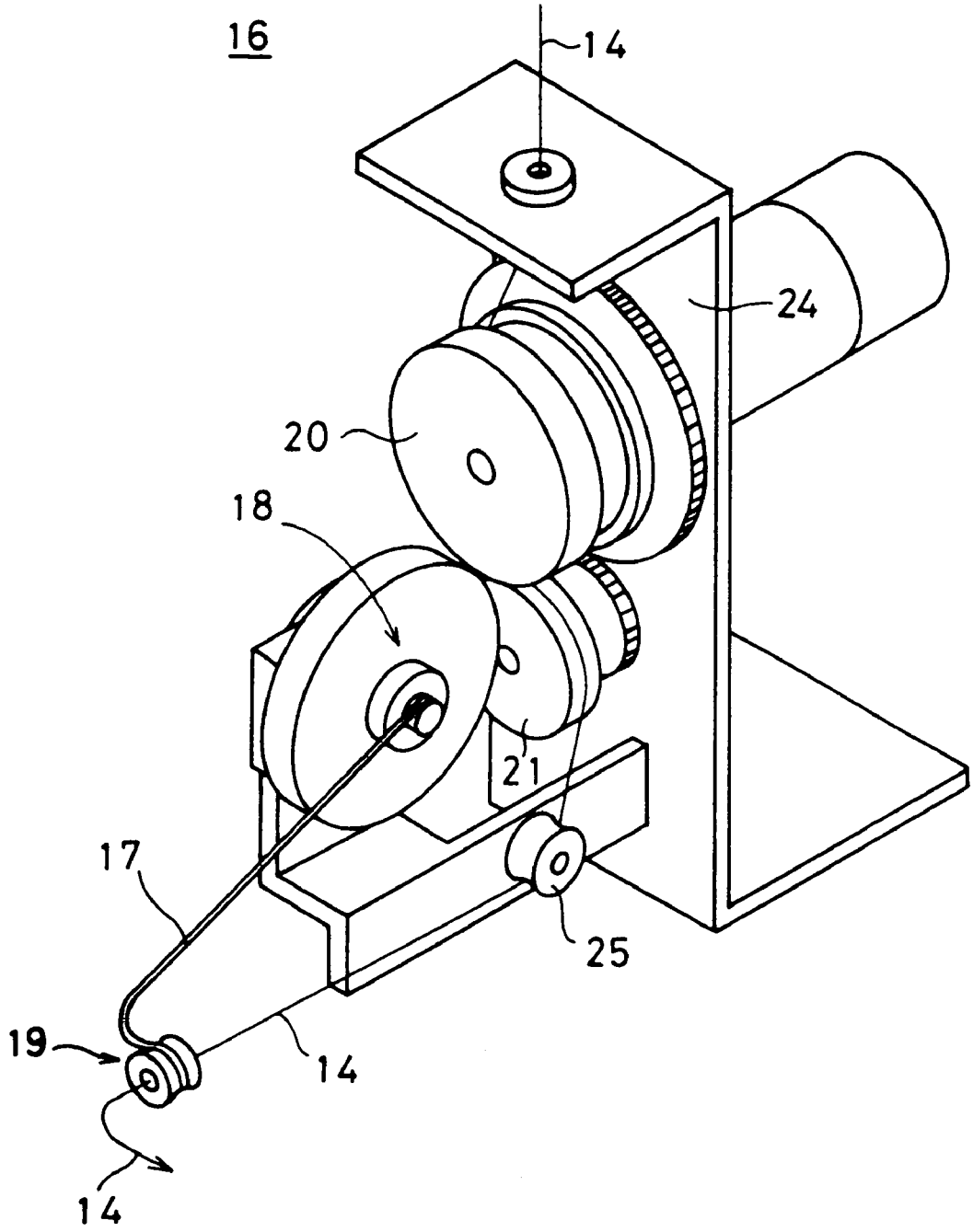
FIG. 4 shows a perspective view of the yarn feeding apparatus 16 in FIG. 1.

FIGS. 2, 3, and 4 show a detailed structure of the yarn feeding apparatus 16. FIG. 2 shows the front view of the yarn feeding apparatus 16 viewed from a similar direction to that in FIG. 1. FIG. 3 shows a left side view thereof, and FIG. 4 shows a perspective view thereof. For convenience, FIG. 1 shows a main roller 20 and a sub roller 21 from a different angle. In FIGS. 1 to 4, the main roller 20 and the sub roller 21 are provided so as to supply the knitting yarn 14 to the buffer rod 17. The main roller 20 is mounted on a rotation axis of a servomotor 22, and the rotation force of the servomotor 22 is transmitted to the sub roller 21 via a driven mechanism 23 in which a plurality of gears are combined. The main roller 20 and the sub roller 21 are arranged in such a manner that the knitting yarn 14 is held between them, and the sub roller 21 is rotary-driven by the driven mechanism 23 at the same circumferential speed as that of the main roller 20. The main roller 20, the sub roller 21, the servomotor 22, and the driven mechanism 23 are fixed on the side cover 15 in FIG. 1 by with a frame 24. Since the diameter of the main roller 20 is small and the sub roller 21 is provided under the main roller 20, one yarn feeding apparatus 16 can have a relatively narrow width, and thus it becomes easy to arrange a plurality of yarn feeding apparatuses 16 on the side cover 15.

The knitting yarn 14 is supplied from above the frame 24, and while keeping in contact with the outer circumferential surface of the main roller 20, is guided to a portion in which the sub roller 21 is opposed to the main roller 20. A slight gap is formed between the outer circumferential surface of the main roller 20 and that of the sub roller 21, through which the knitting yarn 14 passes. Subsequently, the knitting yarn 14 is guided to an intermediate roller 25, and is oriented to a different direction and pulled to the front end side 19 of the buffer rod 17. The base end side 18 of the buffer rod 17 is provided with a spring 26 that applies a force so that the front end side 19 moves away from the surface of the side cover 15. The spring 26 displaces the buffer 17 by swinging in such a manner that the inclination angle is small when the tension of the knitting yarn 14 is large, and that the inclination angle is large when the tension of the knitting yarn 14 is small. The inclination angle of the buffer rod 17 is detected by an inclination angle sensor 27 that is provided at the base end side 18. The inclination angle of the buffer rod 17 can range, for example, from 0° to 100°.

Referring to FIG. 1 again, a needle bed 28 for knitting the knitting fabric 12 is provided in a liner manner in the flat knitting machine 11, and a carriage 29 travels back and forth along the needle bed 28. The carriage 29 lets knitting needles of the needle bed 28 perform a knitting operation and the yarn feeding member 13 move, and thus the knitting fabric 12 is knitted. The carriage 29 is provided with a knitting cam for controlling the to-and-fro movement of the knitting needles, by which a knitting operation of the knitting fabric 12 is performed. An automated flat knitting machine 11 is provided with a knitting controller 30 so that a knitting operation of the knitting fabric 12 can be performed according to knitting data that is given in advance.

In the yarn feeding apparatus 16 of this embodiment, a required amount of the knitting yarn 14 for each knitting needle is calculated according to knitting data, and a yarn feeding controller 31 is provided to control the servomotor 22 so that the knitting yarn is sent out to meet the requirement. The control by the yarn feeding controller 31 can switch the mode between a plurality of modes including a mode of sending out a necessary yarn (referring to as "necessary yarn sending mode") in which the length of the knitting yarn 14 that is necessary for a knitting operation of knitting needles to knit the knitting fabric 12 is calculated in advance based on knitting data, and the knitting yarn 14 of the calculated length is sent out to the yarn feeding member, and a mode of sending a yarn with a constant tension (referred to as "sending mode with a constant tension"), in which the knitting yarn 14 is sent out based on a signal from the inclination angle sensor 27 in such a manner that the front end side 19 of the buffer rod 17 holds an origin position. It should be noted that the required amount of the knitting yarn 14 in the necessary yarn sending mode can be calculated prior to the knitting operation.

Figure 5:
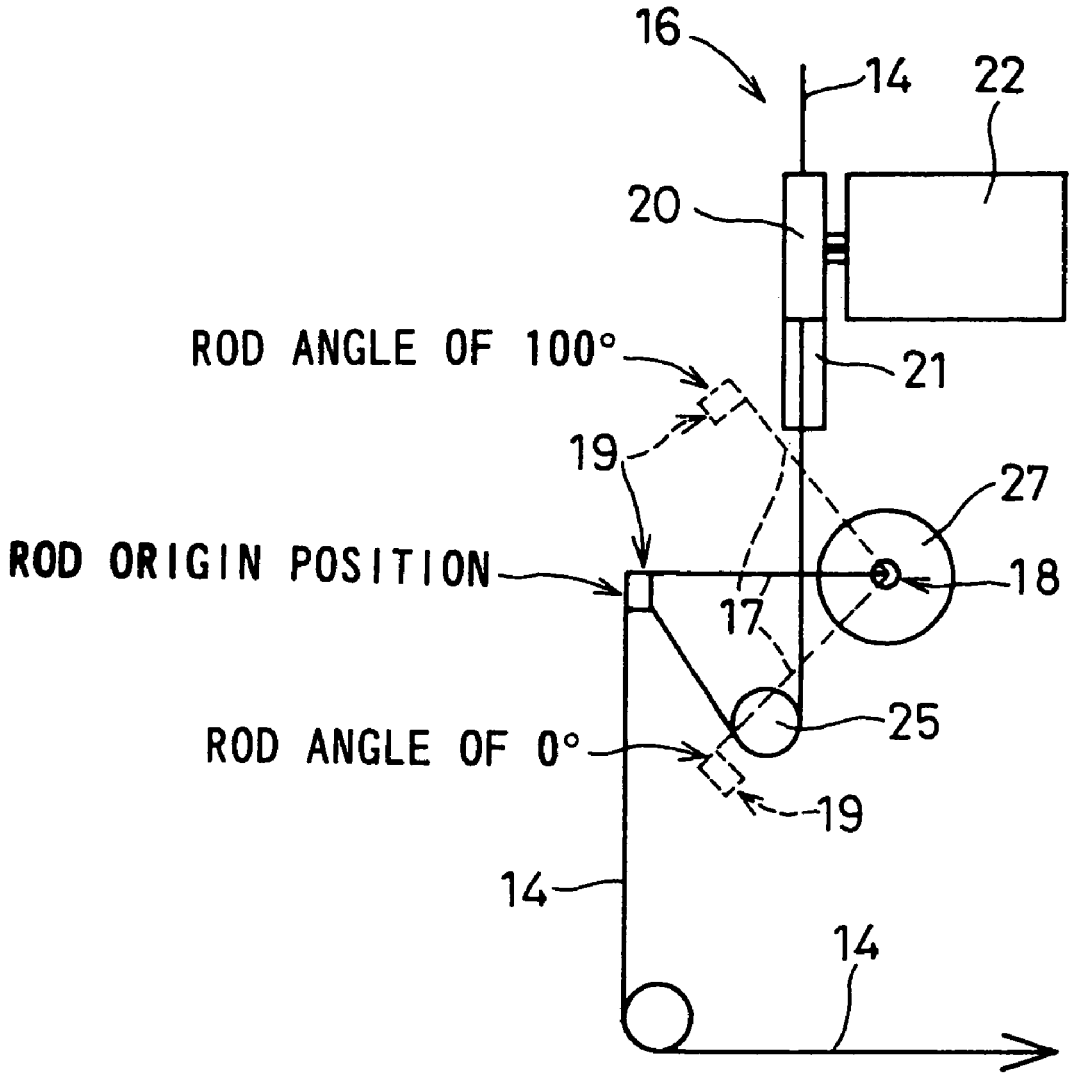
FIG. 5 is a diagram showing a range in which a buffer rod 17 in FIG. 1 can be displaced by swinging.

FIG. 5 shows a range in which the buffer rod 17 can be displaced by swinging. It is assumed that the buffer rod 17 can be displaced by swinging in such a manner that the rod angle formed by a line from the base end side 18 up to the front end side 19 ranges from 0° to 100°. The position of the front end side 19 when the rod angle is in the middle is indicated by solid line as a rod origin position. When the rod angle with respect to the rod origin position is large as indicated by broken line to the side of a rod angle of 100°, the knitting yarn 14 is stored to some extent at the buffer rod 17. Then, by displacing the buffer rod 17 by swinging in such a manner that the rod angle becomes small, the knitting yarn 14 can be supplied to meet a drastic increase of the requirement. Furthermore, when the rod angle with respect to the rod origin position is small as indicated by broken line to the side of a rod angle of 0°, the knitting yarn 14 can be pulled by the buffer rod 17 to some extent. In other words, when the requirement of the knitting yarn 14 decreases, the tension of the knitting yarn 14 decreases, and thus the buffer rod 17 is inclined so as to move away from the side cover 15 by the force of the spring. Consequently, the rod angle increases to pull the excessive knitting yarn 14, so that the tension of the yarn is prevented from decreasing.

However, only by swinging displacement of the buffer rod 17, it is impossible to cope with a drastic change in the required amount of the knitting yarn 14 that occurs while the flat knitting machine 11 knits the knitting fabric 12 at a high speed. The yarn feeding apparatus 16 of this embodiment uses the necessary yarn sending mode in which a change in the required amount of the knitting yarn 14 is estimated in advance, so that a change in the inclination angle of the buffer rod 17 can be suppressed, and thus a change in the tension of the knitting yarn 14 can be suppressed.

Figure 6:
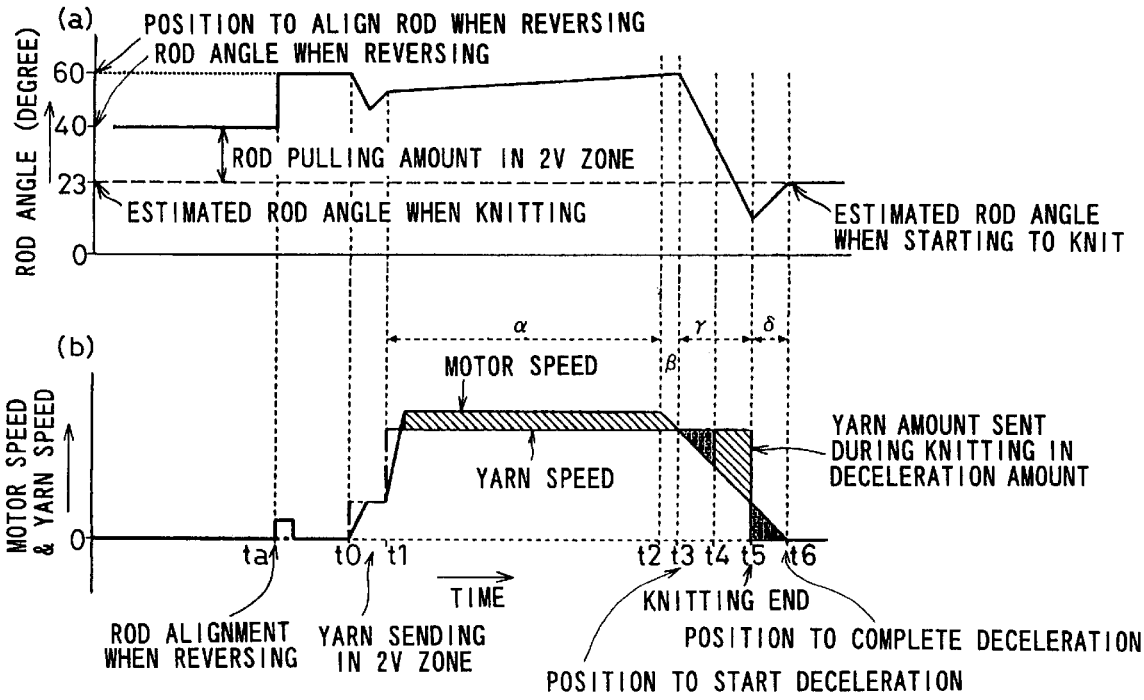
FIG. 6 is a graph showing a basic concept of control for realizing a necessary yarn sending mode in the yarn feeding apparatus 16 of the embodiment shown in FIG. 1.

FIG. 6 shows a basic concept of control for realizing the necessary yarn sending mode in the yarn feeding apparatus 16 of this embodiment. FIG. 6(*a*) shows basic changes of the inclination angle in accordance with swinging displacement of the buffer rod 17 that is plotted against a time during which the yarn feeding member 13 moves a yarn feeding position with respect to the knitting fabric 12 in FIG. 1. FIG. 6(*b*) shows basic changes of the speed of the servomotor 22 that is controlled by the yarn feeding controller 31 as control means and the speed of the knitting yarn 14 that is sent out to the yarn feeding member 13, corresponding to the movement of the yarn feeding position. The changes shown in FIG. 6 correspond to the case that the carriage 29 knits one course of the knitting fabric 12 while moving from the side close to the yarn feeding apparatus 16 to the side away therefrom in FIG. 1.

At a time ta before starting a knitting operation, the yarn feeding member 13 is at rest at a position closer to the yarn feeding apparatus 16 than the knitting end of the knitting fabric 12. The position of the knitting end of the knitting fabric 12 is set to be a position in which a stitch cam mounted on the carriage 29 performs an operation corresponding to a stitch density of 0 for a knitting needle that knits a knitting stitch at the end of the knitting fabric 12. A distance from this position to the center position of the yarn feeding port 13*a* when the yarn feeding member 13 is at the standard stopping position thereof is set to be a standard value of a distance between the knitting end and the yarn feeding port 13*a*. At that time, the rod angle of the buffer rod 17 is, for example, 40°. In the case of setting the rod angle to 60° at the position to align the rod when reversing, control is performed as a rod alignment when reversing in such a manner that the servomotor 22 rotates for a short time to supply the knitting yarn 14 to the buffer rod 17, so that the rod angle increases from 40° to 60°. The rod alignment when reversing refers to an alignment of the rod angle to a predetermined value when the carriage 29 is at rest at a position close to the yarn feeding apparatus 16 after knitting the previous course. In this embodiment, the rod angle is aligned at each time before starting and after completing a knitting operation of one course.

After performing the rod alignment when reversing at the time ta, the carriage 29 starts to move the yarn feeding member 13 at a time t0. For convenience, it is assumed that the carriage 29 moves at a constant speed of V. Until the yarn feeding member 13 moves in the 2V zone to reach the knitting end of the knitting fabric 12 at a time t1, the servomotor 22 is controlled to send out the knitting yarn 14 at twice as fast as the carriage. In this zone, the yarn feeding member 13 moves from a position indicated by broken line to a position indicated by solid line. The knitting yarn 14 is necessary for a length from the front end side 19 of the buffer rod 17 to the yarn feeding port 13*a*, and a length from the yarn feeding port 13*a* to the knitting needle at the knitting end. Therefore, when the carriage 29 brings the yarn feeding port 13*a* away from the front end side 19 of the buffer rod 17 at a speed of V, it is necessary to supply the knitting yarn 14 at a yarn speed of 2V.

In FIG. 6(*b*), the dashed dotted line shows the yarn speed that is necessary during the movement of the carriage 29. As indicated by the solid line, the rotation speed of the servomotor 22 rises behind the carriage 29. Thus, the rod angle of the buffer rod 17 decreases as shown in FIG. 6(*a*), and a shortfall of the knitting yarn 14 is replenished.

An α zone, in which the knitting yarn 14 is used for knitting one course of the knitting fabric 12, starts at the time t1. In the a zone, the motor speed of the servomotor 22 is controlled so as to send out the knitting yarn 14, as a whole, of a sending amount calculated by the following formula (1). "In withdrawing from knitting end" refers to a point of time when withdrawing from the knitting end after knitting up to the end of the knitting fabric.

Formula (1)

Sending amount=(sum of yarn amounts for each needle)−(amount for rod alignment when reversing)−(yarn sending amount in the 2V zone)+(amount for deceleration in withdrawing from knitting end)

The "yarn amount for each needle" will be described later. The "amount for rod alignment when reversing" refers to the length of the knitting yarn 14 that is sent out at the time ta. The "yarn sending amount in the 2V zone" refers to the length of the knitting yarn 14 that is sent out from the time t0 to the time t1. In the α zone, the knitting yarn 14 that has been supplied from the buffer rod 17 at the beginning of the 2V zone is also supplied, and the maximum motor speed is set to be higher than the yarn speed since the motor speed rises behind the yarn speed. The end of the knitting operation of the knitting fabric 12 is preceded by deceleration of the servomotor 22. The α zone ends at the time t2 when the deceleration of the servomotor 22 starts. The amount for deceleration in withdrawing from knitting end in the α zone corresponds to the area of the portion hatched with downward sloping lines.

A β zone extends from the time t2 up to a time t3 when the motor speed becomes equal to the yarn speed. In the β zone, the motor speed of the servomotor 22 is controlled so as to send out the knitting yarn 14, as a whole, of a sending amount calculated by the following formula (2).

Formula (2)

Sending amount=(sum of yarn amounts for each needle)−(amount for rod alignment when reversing)−(yarn sending amount in the 2V zone)+(uncompleted amount of first average)+(amount for deceleration in withdrawing from knitting end)

The "uncompleted amount of first average" will be described later. The amount for deceleration in withdrawing from knitting end in the β zone also corresponds to the area of the portion hatched with downward sloping lines that is continuous from the α zone.

A γ zone extends from the time t3 up to a time t5 when the yarn feeding port 13*a* reaches the knitting end of the knitting fabric 12. In the γ zone, the motor speed of the servomotor 22 is controlled so as to send out the knitting yarn 14, as a whole, of a sending amount calculated by the following formula (3).

Formula (3)

Sending amount=(sum of yarn amounts for each needle)−(amount for rod alignment when reversing)−(yarn sending amount in the 2V zone)+(uncompleted amount of first average)−(amount for deceleration in withdrawing from knitting end)

In the γ zone, the motor speed is lower than the yarn speed, which results in a shortage of the knitting yarn 14. This shortfall is referred to, as the amount for deceleration in withdrawing from knitting end, a part of which is supplied by displacing the buffer rod 17 by swinging in such a manner that the rod angle becomes small. More specifically, in the portion corresponding to the shortfall length of the knitting yarn 14, the portion hatched with downward sloping lines is equivalent to the portion hatched with downward sloping lines in the zones α and β in which the motor speed is higher than the yarn speed. As the amount for deceleration in withdrawing from knitting end, the half-tone portion still remains.

The half-tone portion in the amount for deceleration in withdrawing from knitting end is replenished by the knitting yarn 14 that is sent out from the time t5 when the carriage 29 stops up to a time t6 when the servomotor 22 stops. In other words, the knitting yarn 14 corresponding to the half-tone portion is supplied from the knitting end to the position for completing the deceleration, and thus the rest of the amount for deceleration in withdrawing from knitting end is replenished.

In the actual movement of the carriage 29, acceleration to reach the speed V and deceleration from the speed V to stop are necessary. It is similarly necessary that the control over the servomotor 22 is performed following the control over the carriage 29, and that the amount for deceleration in withdrawing from knitting end is replenished before starting the deceleration also in the case where acceleration and deceleration control is performed in the movement of the carriage 29. Furthermore, except that there is no 2V zone, control when the carriage 29 moves leftward is basically similar to that when the carriage moves rightward.

It is necessary to change a yarn amount Y that is sent out for each needle in synchronization with the movement of the yarn feeding member 13 according to a direction in which the carriage 29 moves. For convenience, a case in which the yarn feeding member 13 moves from the side close to the yarn feeding apparatus 16 to the side away therefrom as shown in FIG. 1 is referred to as a "moving rightward operation" and a case in which the yarn feeding member 13 moves in an opposite direction is referred to as a "moving leftward operation." In either case, the knitting yarn 14 is not sent in a zone before knitting. When a "pitch" refers to spacing of arranged needles and an "L" refers to a knitting stitch loop length, a moving rightward operation needs to send out a knitting yarn for a length obtained by adding the knitting stitch loop length L and the pitch, whereas a moving leftward operation needs to send out a knitting yarn for a length obtained by subtracting the pitch from the knitting stitch loop length L.

Figure 7:
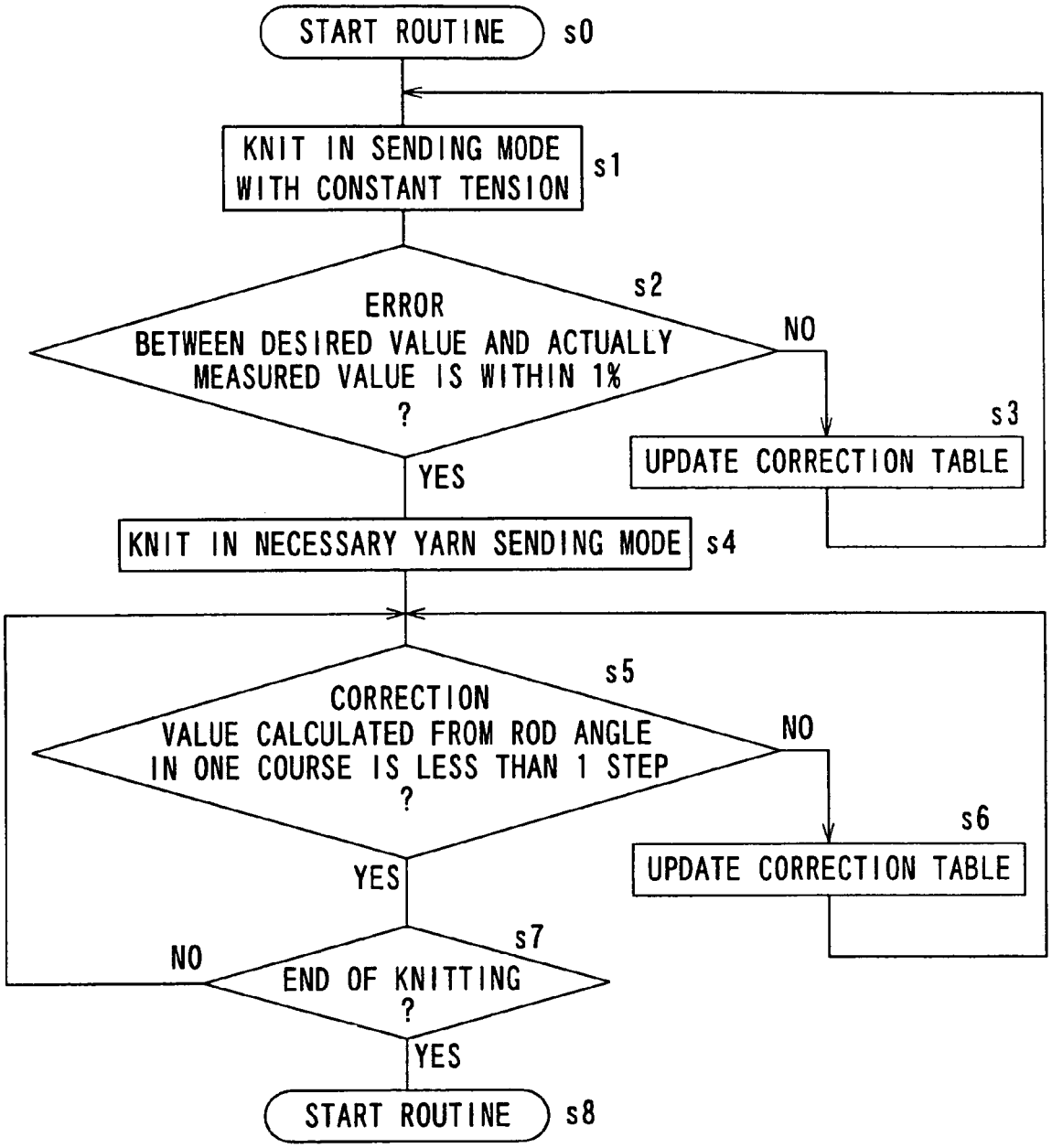
FIG. 7 is a flow chart showing a stitch alignment routine that is carried out in the embodiment shown in FIG. 1.

FIG. 7 shows a stitch alignment routine for aligning a knitting stitch loop length accurately. Even when a yarn amount that is necessary for knitting is calculated and supplied, without an accurate adjustment of a setting of the flat knitting machine 11 affecting a knitting stitch loop length, it is impossible to knit the knitting yarn 14 that is supplied. A cam mechanism for mechanically controlling a knitting operation of knitting needles is mounted on the carriage 29, and in particular a stitch cam for pulling a knitting yarn with a knitting needle after forming a knitting stitch is configured so as to be displaced and adjust a knitting stitch loop length to be knitted. In the flat knitting machine 11 shown in FIG. 1, one or plurality of stitch cams that can monitor a displacement state as a stitch density value and is digitally controllable are mounted on the carriage 29, and the stitch density value for knitting a designated knitting stitch loop length can be determined by performing a stitch alignment routine for each stitch cam. It should be noted that it is possible to adjust the knitting stitch loop length by changing the tension of the knitting yarn 14.

In Step s0, the stitch alignment routine starts, and in Step s1, a stitch density value is set to a default value, and then a knitting fabric is tentatively knitted in the sending mode with a constant tension. In Step s2, an actual measurement value and a theoretical value of the knitting yarn 14 that was used for knitting are compared with each other, and then it is determined whether or not the error is within a predetermined value, for example, 1%. When the error is large, a correction table is updated so as to correct the default value of the stitch density value, and then the procedure returns to Step s1. When the error is within the predetermined value in Step s2, the stitch alignment with a constant tension ends. Such a stitch alignment with a constant tension is carried out before knitting a knitting fabric that is to be actually produced. The correction table will be described later.

In an actual knitting operation of a knitting fabric, in Step s4, the mode is switched to the necessary yarn sending mode and one course is knitted. In Step s5, a correction value is calculated based on a difference in the inclination angles of the buffer rod 17 before and after knitting one course. Then, it is determined whether or not the correction value is within a predetermined value, for example, one step. When the correction value is not within the predetermined value, the procedure moves into Step s6, in which the correction table is updated, and then returns to Step s4. When the correction value is determined to be within the predetermined value in Step s5, it is determined whether or not the knitting operation has ended in Step s7. When it is determined that the knitting operation has not ended, the procedure returns to Step s5. When it is determined that the knitting operation has ended in Step s7, the routine ends in Step s8.

In other words, since a sending amount of the knitting yarn 14 is determined, for example, by a knitting stitch loop length and a knitting structure that are prescribed by knitting data, the correction is possible by increasing or decreasing the stitch density value. Since an excess or a shortfall of the knitting yarn 14 corresponds to a change in the rod angle of the buffer rod 17, this correspondence is set to be correction table data. In each knitting course, by comparing the rod angles at the start and the end of the knitting operation, it is possible to compare the amount of knitting yarn 14 that has been sent out with the amount of knitting yarn 14 that has been knitted into the knitting fabric 12.

When the rod angle at the knitting start>the rod angle at the knitting end, which indicates that the knitting amount is larger than the sending amount, the stitch density value is set to be smaller.

When the rod angle at the knitting start<the rod angle at the knitting end, which indicates that the knitting amount is smaller than the sending amount, the stitch density value is set to be larger.

In each course, the stitch density value is corrected also by comparing the angle of the buffer rod 17 corresponding to the origin position with the rod angle corresponding to the knitting end position.

When the rod angle at the origin position>the rod angle at the knitting end, which indicates that the buffer rod 17 is close to the lower limit position, the stitch density value is set to be smaller.

When the rod angle at the origin position<the rod angle at the knitting end, which indicates that the buffer rod 17 is close to the upper limit position, the stitch density value is set to be larger.

The point of the origin position correction with respect to the buffer rod 17 as described above lies not in aligning the buffer rod accurately at each time of knitting one course, but in knitting accurately so that the amount of the knitting yarn 14 calculated and sent out is neither too much or too little as the total of all the courses. The position of the rod angle is set, for example, to 43° in a moving rightward operation, and to 60° in a moving leftward operation. The rod position is aligned to 60° in the moving rightward operation, and to 60° in the moving leftward operation. The angle of the buffer rod 17 is also forcibly corrected. For example, in the moving rightward operation, the stitch density value is added by 1 at an upper limit of 60°, and is subtracted by 1 at a lower limit of 30°. In the moving leftward operation, the stitch density value is added by 1 at an upper limit of 70°, and is subtracted by 1 at a lower limit of 40°.

Furthermore, since the range of the inclination angle of the buffer rod 17 is limited, a remedy is prepared. More specifically, when the buffer rod 17 reaches the upper or the lower limit position during control in the necessary yarn sending mode, there is a possibility that the yarn is broken and to stop knitting. In order to avoid this state, the remedy is performed. The remedy processing starts when the buffer rod 17 reaches, for example, an upper limit of 95° or a lower limit of 10°, and controls the knitting yarn 14 not to be sent out or to be sent out until the buffer rod 17 reaches a remedy ending angle, that is, an upper limit of 75° or a lower limit of 45°. When the buffer rod 17 reaches the remedy ending angle, the mode is switched to the sending mode with a constant tension, and the front end side 19 of the buffer rod 17 is controlled to hold the origin position.

The correction table data is divided into a first correction table and a second correction table, and values of the two correction tables are added to the default value of the stitch density value, so that the stitch density value is corrected. The first correction table shows values obtained by adding the total value of (i) the previous correction of the rod origin position and (ii) the correction of the rod change to the previous value. The second correction table shows values of (iii) the correction of the rod origin position, and the value is reflected on the first correction table in the next time, and then is reset. A conversion from a yarn length (mm) to a stitch density value (step) is performed by a conversion formula that is set based on, for example, an empirical value. A state in which all the correction values of (i) to (iii) become within one step is regarded as a "completion," and the correction of the stitch density is ended. The first correction table is used for knitting the knitting yarn 14 only in an amount that is necessary for the knitting operation. The second correction table is used for returning the buffer rod 17 to the origin position.

FIG. 8 shows an example of the correction table data in a moving rightward operation. The example shows a transition of the correction table data when a default value of a setting loop length is set to a "stitch density value of 42," and a stitch density value at which the setting loop length is achieved is set to a "stitch density value of 40."

Figure 9:
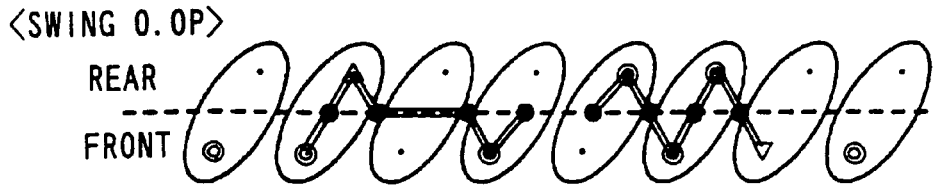
FIG. 9 shows an example of a pattern analysis that is carried out in the embodiment shown in FIG. 1.
Figure 10:
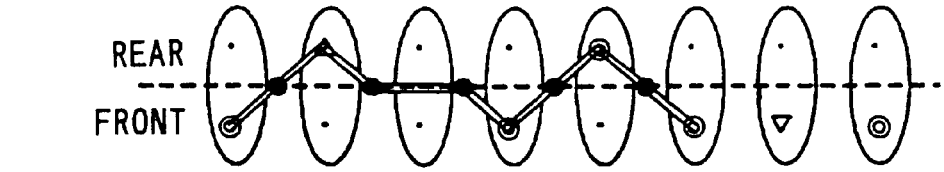
FIG. 10 shows an example of a pattern analysis that is carried out in the embodiment shown in FIG. 1.
Figure 11:
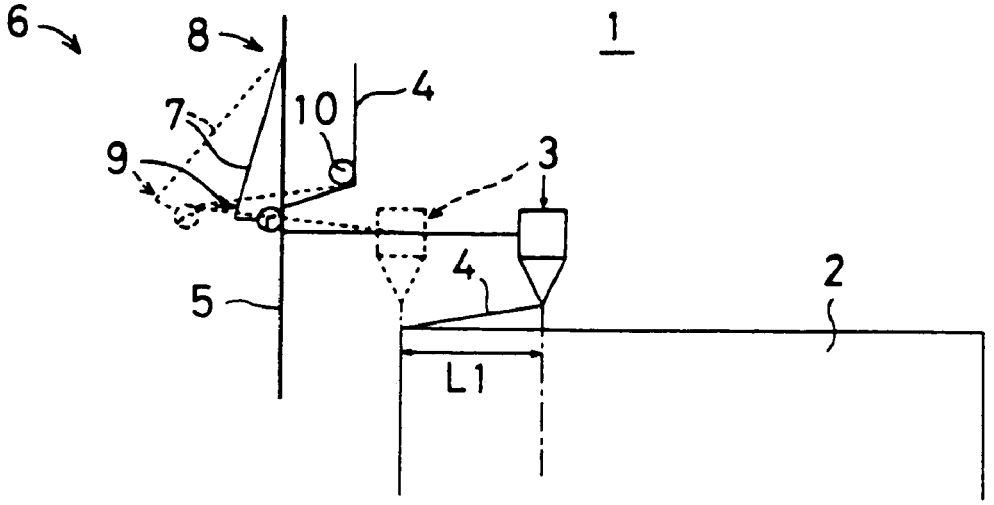
FIG. 11 is a diagram showing a reason why the length of a knitting yarn 14 cannot be measured accurately within a certain range of a knitting fabric from the side close to a yarn feeding apparatus, in the case of a conventional yarn feeding apparatus.
Figure 12:
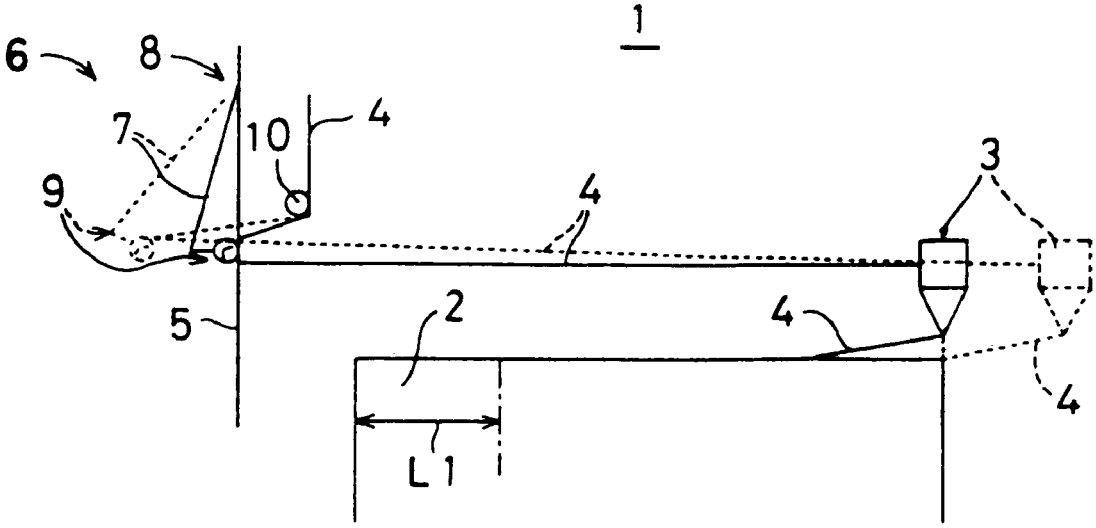
FIG. 12 is a diagram showing that the length of a knitting yarn supplied by a yarn feeding port in the vicinity of an end of a knitting fabric away from the yarn feeding apparatus cannot be measured accurately, in the case of the conventional yarn feeding apparatus.

FIGS. 9 and 10 show examples of a pattern analysis. FIG. 9 shows a case in which a swing is not performed on the front and the rear needle beds, and FIG. 10 shows a case in which a swing of 0.5 pitch is performed. First, the numbers of knit portions, tuck portions, misses, and crossing portions are analyzed for each knitting needle. Hereby, a "crossing portion" means a portion of a crossing yarn that connects between a knitting stitch on the side of the front needle bed and a knitting stitch on the side of the rear needle bed. The knitting stitch loop length L can be calculated based on a length per knitting structure, as an amount of the knitting yarn 14 that is necessary for one knitting needle. This knitting stitch loop length L is set to correspond to a knit portion. A tuck portion and a miss are based on respective formulas. A crossing portion is based on a formula that is selected based on a swing pitch.

It should be noted that the number of knit portions or tuck portions is set to 0, 1, or 2, depending on the number of knitting needles that are included in an ellipse. The number of misses is set to 0 or 1. The number of crossing portions is set to 0.5 when selected knitting needles are on needle beds on which the knitting needles are opposed to each other immediately before being selected. Furthermore, the number of crossing portions is set to 0.5 when selected knitting needles are on needle beds on which the knitting needles are opposed to each other immediately after being selected.

The "yarn amount for each needle" that is shown in the formulas (1), (2), and (3) is an average of the amount of the knitting yarn 14 that is necessary for the knitting needle and a plurality of, for example, eleven following knitting needles that are used for knitting. By using such an average of the twelve knitting needles, a change in a requirement of a yarn for each knitting needle is flattened, so that a vibration does not occur when controlling the servomotor 22. On the side of the knitting end of the knitting fabric 12, it becomes impossible to secure the following eleven knitting needles. In this case, data on the side of knitting start is used as the "uncompleted amount of first average" that is shown in the zones β and γ in FIG. 6. This enables the data for each knitting needle to be used equally and to be reflected on one course equally. It is also possible to divide knitting needles into groups in accordance with, for example, a structure pattern when performing a pattern analysis, and to supply a knitting yarn based on an average value that is calculated for each group. In the groups, it is possible to avoid a drastic change in the knitting yarn supplied amount per knitting needle.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

As described above, according to the invention, the control means controls the knitting yarn sending mechanism, a pattern analysis is performed based on knitting data, and the length of a yarn that is necessary for knitting a knitting fabric in accordance with a knitting operation of a knitting needle is calculated in advance. Therefore, it is possible to estimate a required amount of the knitting yarn accurately, so that the knitting operation can be performed while supplying the knitting yarn that is necessary for the knitting operation.

Furthermore, according to the invention, at least one of the stitch density as a preset value of the knitting cam for knitting stitches and the tension of the knitting yarn is corrected before and after knitting the knitting fabric for one course so that an angle change of swinging displacement of the buffer rod is reduced. Therefore, it is possible to adjust the amount of the supplied knitting yarn accurately also in the entire knitting fabric.

Furthermore, according to the invention, as the length of a knitting yarn that is supplied to each knitting needle, an average value of knitting stitch loop lengths that are calculated for knitting needles in a group including the knitting needle is used. Therefore, it is possible to avoid control in which the length of a knitting yarn that is sent out from the knitting yarn sending mechanism changes drastically, for example, at a boundary of a pattern, so that a change in the length of the knitting yarn supplied caused by a vibration in an excessive response of control system can be prevented.

Furthermore, according to the invention, also in the case of control in the necessary yarn sending mode, the buffer rod is aligned in such a manner that the position of the front end side of the buffer rod stays in a predetermined vicinity of the origin position, before and after knitting one course of a knitting fabric, by using a part of a knitting yarn sent during a knitting operation. Therefore, it is possible to cope with an unexpected change in a yarn requirement during knitting the knitting fabric by swinging displacement of the buffer rod.

Furthermore, according to the invention, when a swinging displacement state of the buffer rod is beyond a predetermined limit during control in the necessary yarn sending mode, the control in the necessary yarn sending mode is stopped, and the knitting yarn sending mechanism is controlled in the remedy mode in which the front end side of the buffer rod is returned to the origin position. Therefore, it is possible to prevent a state in which a change in the length of a knitting yarn supplied cannot be absorbed by swinging displacement of the buffer rod, and thus a yarn break of the knitting yarn caused by an excessive tension and winding caused by loss of the tension can be prevented.

Furthermore, according to the invention, a yarn sending mode can be switched also to a sending mode with a constant tension. Therefore, it is possible to knit a knitting fabric with a stable tension applied to a knitting yarn.

Furthermore, according to the invention, it is possible to adjust the knitting cam for knitting stitches in the sending mode with a constant tension.

Furthermore, according to the invention, a length of a knitting yarn to be sent out is calculated according to the knitting data, separately for a zone in which the knitting yarn is sent out before starting a knitting operation at one end of a knitting fabric, a zone from the start of the knitting operation at the end of the knitting fabric to a start of deceleration of sending out the knitting yarn from the knitting yarn sending mechanism, a zone from the start of deceleration of sending out the knitting yarn from the knitting yarn sending mechanism to a completion of knitting up to the other end of the knitting fabric, and a zone from the completion of the knitting operation of the knitting fabric to a stop the knitting yarn sending mechanism. Therefore, it is possible to supply a knitting yarn appropriately in light of the inertia of the knitting yarn sending mechanism against acceleration or deceleration when knitting a knitting fabric.

The invention claimed is:

1. A yarn feeding apparatus of a flat knitting machine that supplies a knitting yarn to knitting needles performing a knitting operation based on knitting data while moving a yarn feeding member in a width direction of a knitting fabric, comprising:

a knitting yarn sending mechanism that is provided on a supplying path of a knitting yarn and that sends out the knitting yarn to the yarn feeding member;

a buffer rod that is provided on a path on which a knitting yarn is supplied from the knitting yarn sending mechanism to the yarn feeding member, that can be displaced by swinging around a base end side, that pulls partially the knitting yarn out of the path when a front end side thereof is displaced to one side by swinging, and that returns the knitting yarn to the path when the front end side is displaced to the other side by swinging;

a spring that applies a force to the buffer rod in such a manner that the front end thereof is displaced to the one side by swinging so that the knitting yarn of a predetermined length is pulled out of the path with a predetermined tension of the yarn;

a sensor that detects a swinging displacement state of the buffer rod using as a reference an origin that is a position of the front end side when the knitting yarn is pulled out of the path only for the predetermined length, and that derives a signal showing a detection result; and control means for performing a pattern analysis based on knitting data, for calculating a theoretical value of a knitting stitch loop length to be knitted for each knitting needle, for controlling the knitting yarn sending mechanism in a necessary yarn sending mode in which the knitting yarn is sent out in synchronization with a movement of the yarn feeding member, and for correcting an element affecting a predetermined knitting switch loop length before and after knitting one course of a knitting fabric in such a manner that an error between a length of a knitting yarn supplied for one course actually measured by the sensor based on an angle change in the swinging displacement of the buffer rod and a theoretical value of the knitting stitch loop length for one course is absorbed.

2. The yarn feeding apparatus of the flat knitting machine of claim 1, wherein as the element affecting the knitting stitch loop length, at least one of a stitch density as a preset value of a knitting cam for knitting stitches and a tension of the knitting yarn is corrected.

3. The yarn feeding apparatus of the flat knitting machine of claim 2, wherein the control means performs control in the necessary yarn sending mode in such a manner that as the knitting stitch loop length calculated for each knitting needle, an average value of knitting stitch loop lengths of knitting needles belonging to a group including the knitting needle at a knitting stitch for knitting a same course of a knitting fabric is sent out from the knitting yarn sending mechanism.

4. The yarn feeding apparatus of the flat knitting machine of claim 1, wherein the control means aligns the buffer rod, during control in the necessary yarn sending mode, based on a detection result by the sensor, by using a part of a knitting yarn sent during a knitting operation, in such a manner that the position of the front end side of the buffer rod stays in a predetermined vicinity of the origin position, before and after knitting one course of a knitting fabric.

5. The yarn feeding apparatus of the flat knitting machine of claim 1, wherein the sensor detects that a swinging displacement state of the buffer rod is beyond a predetermined limit during control in the necessary yarn sending mode, the control means stops the control in the necessary yarn sending mode, and controls the knitting yarn sending mechanism in a remedy mode in which the front end side of the buffer rod is returned to the origin position.

6. The yarn feeding apparatus of the flat knitting machine of claim 1, wherein the controlling means controls the knitting yarn sending mechanism in a switchable mode between the necessary yarn sending mode and a mode with a constant tension in which based on a signal from the sensor, the front end side of the buffer rod is controlled to be kept in a vicinity of the origin position so that a tension of the knitting yarn is kept constant.

7. The yarn feeding apparatus of the flat knitting machine of claim 6, wherein the control means performs adjustment prior to a knitting operation of a knitting fabric in the mode with a constant tension in such a manner that a stitch density as the preset value of the knitting cam for knitting stitches is adjusted so that a predetermined loop length can be knitted.

8. The yarn feeding apparatus of the flat knitting machine of claim 1, wherein the control means calculates a length of a knitting yarn to be sent out according to the knitting data, separately for a zone in which the knitting yarn is sent out before starting a knitting operation at one end of a knitting fabric, a zone from the start of the knitting operation at the end of the knitting fabric to a start of deceleration of sending out the knitting yarn from the knitting yarn sending mechanism, a zone from the start of deceleration of sending out the knitting yarn from the knitting yarn sending mechanism to a completion of knitting up to the other end of the knitting fabric, and a zone from the completion of the knitting operation of the knitting fabric to a stop the knitting yarn sending mechanism.

9. The yarn feeding apparatus of the flat knitting machine of claim 2, wherein the control means aligns the buffer rod, during control in the necessary yarn sending mode, based on a detection result by the sensor, by using a part of a knitting yarn sent during a knitting operation, in such a manner that the position of the front end side of the buffer rod stays in a predetermined vicinity of the origin position, before and after knitting one course of a knitting fabric.

10. The yarn feeding apparatus of the flat knitting machine of claim 3, wherein the control means aligns the buffer rod, during control in the necessary yarn sending mode, based on a detection result by the sensor, by using a part of a knitting yarn sent during a knitting operation, in such a manner that the position of the front end side of the buffer rod stays in a predetermined vicinity of the origin position, before and after knitting one course of a knitting fabric.

11. The yarn feeding apparatus of the flat knitting machine of claim 2, wherein the sensor detects that a swinging displacement state of the buffer rod is beyond a predetermined limit during control in the necessary yarn sending mode, the control means stops the control in the necessary yarn sending mode, and controls the knitting yarn sending mechanism in a remedy mode in which the front end side of the buffer rod is returned to the origin position.

12. The yarn feeding apparatus of the flat knitting machine of claim 3, wherein the sensor detects that a swinging displacement state of the buffer rod is beyond a predetermined limit during control in the necessary yarn sending mode, the control means stops the control in the necessary yarn sending mode, and controls the knitting yarn sending mechanism in a remedy mode in which the front end side of the buffer rod is returned to the origin position.

13. The yarn feeding apparatus of the flat knitting machine of claim 4, wherein the sensor detects that a swinging displacement state of the buffer rod is beyond a predetermined limit during control in the necessary yarn sending mode, the control means stops the control in the necessary yarn sending mode, and controls the knitting yarn sending mechanism in a remedy mode in which the front end side of the buffer rod is returned to the origin position.

14. The yarn feeding apparatus of the flat knitting machine of claim 2, wherein the controlling means controls the knitting yarn sending mechanism in a switchable mode between the necessary yarn sending mode and a mode with a constant tension in which based on a signal from the sensor, the front end side of the buffer rod is controlled to be kept in a vicinity of the origin position so that a tension of the knitting yarn is kept constant.

15. The yarn feeding apparatus of the flat knitting machine of claim 3, wherein the controlling means controls the knitting yarn sending mechanism in a switchable mode between the necessary yarn sending mode and a mode with a constant tension in which based on a signal from the sensor, the front end side of the buffer rod is controlled to be kept in a vicinity of the origin position so that a tension of the knitting yarn is kept constant.

16. The yarn feeding apparatus of the flat knitting machine of claim 4, wherein the controlling means controls the knitting yarn sending mechanism in a switchable mode between the necessary yarn sending mode and a mode with a constant tension in which based on a signal from the sensor, the front end side of the buffer rod is controlled to be kept in a vicinity of the origin position so that a tension of the knitting yarn is kept constant.

17. The yarn feeding apparatus of the flat knitting machine of claim 5, wherein the controlling means controls the knitting yarn sending mechanism in a switchable mode between the necessary yarn sending mode and a mode with a constant tension in which based on a signal from the sensor, the front end side of the buffer rod is controlled to be kept in a vicinity of the origin position so that a tension of the knitting yarn is kept constant.

* * * * *